United States Patent [19]

Sadigh-Behzadi

[11] Patent Number: 4,473,267

[45] Date of Patent: Sep. 25, 1984

[54] ELECTRICAL CONNECTOR FOR USE IN ADVERSE ENVIRONMENTS

[75] Inventor: Amir-Akbar Sadigh-Behzadi, Van Nuys, Calif.

[73] Assignee: Thomas & Betts Corporation, Raritan, N.J.

[21] Appl. No.: 243,043

[22] Filed: Mar. 12, 1981

[51] Int. Cl.[3] ..... H01R 13/52

[52] U.S. Cl. ..... 339/94 M; 339/59 M

[58] Field of Search ..... 339/95 R, 95 M, 63 R, 339/63 M, 92 R, 92 M, 94, 176 M, 59 M

[56] References Cited

U.S. PATENT DOCUMENTS

| | | | |
|---|---|---|---|
| 2,881,406 | 4/1959 | Arson | 339/94 M X |
| 2,903,668 | 9/1959 | Cornell | 339/92 M X |
| 3,333,229 | 7/1967 | Dean et al. | 339/99 |
| 3,444,506 | 5/1969 | Wedekind | 339/99 |
| 3,571,779 | 3/1971 | Collier | 339/18 |
| 4,030,799 | 6/1977 | Venalek | 339/99 |

*Primary Examiner*—Eugene F. Desmond

*Attorney, Agent, or Firm*—Robert M. Rodrick; Salvatore J. Abbruzzese

[57] ABSTRACT

A connector for use in environments promotive of galvanic action and corrosion includes a housing supporting a plurality of contacts extending through a resilient member nestably seated in the housing and through a housing closure insert nestably seated in the resilient member. Multiple sealing interfaces are provided by the resilient member under force improsed thereon in assembly of the connector components.

13 Claims, 3 Drawing Figures

ELECTRICAL CONNECTOR FOR USE IN ADVERSE ENVIRONMENTS

FIELD OF THE INVENTION

This invention relates generally to electrical connectors and pertains particularly to connectors adapted for use in adverse environments in which moisture or other contaminants may be present.

BACKGROUND OF THE INVENTION

While the recognition of deleterious consequences of moisture as promotive of galvanic action and corrosion in electrical equipment, and avoidance of such consequences by various sealing, potting, etc., practices have been widely addressed, ready and relatively inexpensive measures for providing environmental-proofing of so-called "flat cable connectors" have remained heretofore largely unrealized. One effective approach, specific to flat multiconductor cable and insulation-piercing termination thereof, is set forth in commonly-assigned, copending U.S. application Ser. No. 77,560, filed on Sept. 21, 1979 and entitled "Environmental Seal and Method". As disclosed therein, the flat cable is sealed fully, by prescribed application of adhesive tape thereto, prior to insulation-piercing termination. Following such preassembly of cable and tape, the tape also presents complete exterior adhesive composition over the expanse thereof to be insulation-pierced. Accordingly, in the course of forcing contacts through the cable insulation into gas-tight connection with cable conductors, the exterior adhesive is directed into fluid-sealed relation with the contacts adjacent both opposite sides of the cable.

Typically, such insulation-piercing contacts extend opposite their cable-piercing ends to pins or sockets which are supported in the connector housing in so-called "D" configuration, an industry standard output terminal arrangement for interconnection purposes. Where environmental-proofness is to extend through the interconnect, i.e., throughout the connection interface of two such "D" connectors, the approach of the referenced copending application provides but a partial solution. Nor has a ready and relatively inexpensive solution complemental to the partial solution heretofore been known, as is seen from the discussion of prior art techniques set forth in the statement filed herein pursuant to 37 CFR 1.97 and 1.98.

SUMMARY OF THE INVENTION

The present invention has as its primary object the provision of improved electrical connectors for use in adverse environments promotive of galvanic action and/or corrosion of electrical contacts.

A more particular object of the invention is to provide an environmental-proof multiple contact connector for use in providing separable connection of terminated flat cable and accessory apparatus.

In attaining the foregoing and other objects, the invention provides a connector having a housing with a recess adjacent a wall through which contacts extend. A resilient member is nested in the wall recess and has contact passages therethrough. An exterior wall of the resilient member is also recessed and a rigid insert is forcibly nested therein to be perimetrically contiguous with the resilient member and to place the resilient member itself in perimetrically contiguous relation with housing structure bounding the housing recess. The insert has a continuous open expanse through which the contacts extend for connection with accessory apparatus.

In a preferred embodiment, an endless rib projects from the resilient member and the insert has a projection fully circumscribing the rib. The insert is forced against the resilient member by securing devices located marginally of the contacts and extending through the insert, the resilient member and into the housing. Multiple seals are provided by the resilient member in such arrangement, i.e., between itself and the contacts, between itself and the housing, between itself and accessory apparatus, and between itself and a mounting panel.

These and other features of the invention will be further understood from the following detailed description of the preferred embodiment thereof and from the drawings wherein like reference numerals identify like parts throughout.

DESCRIPTION OF THE PREFERRED EMBODIMENT

Figure 1:
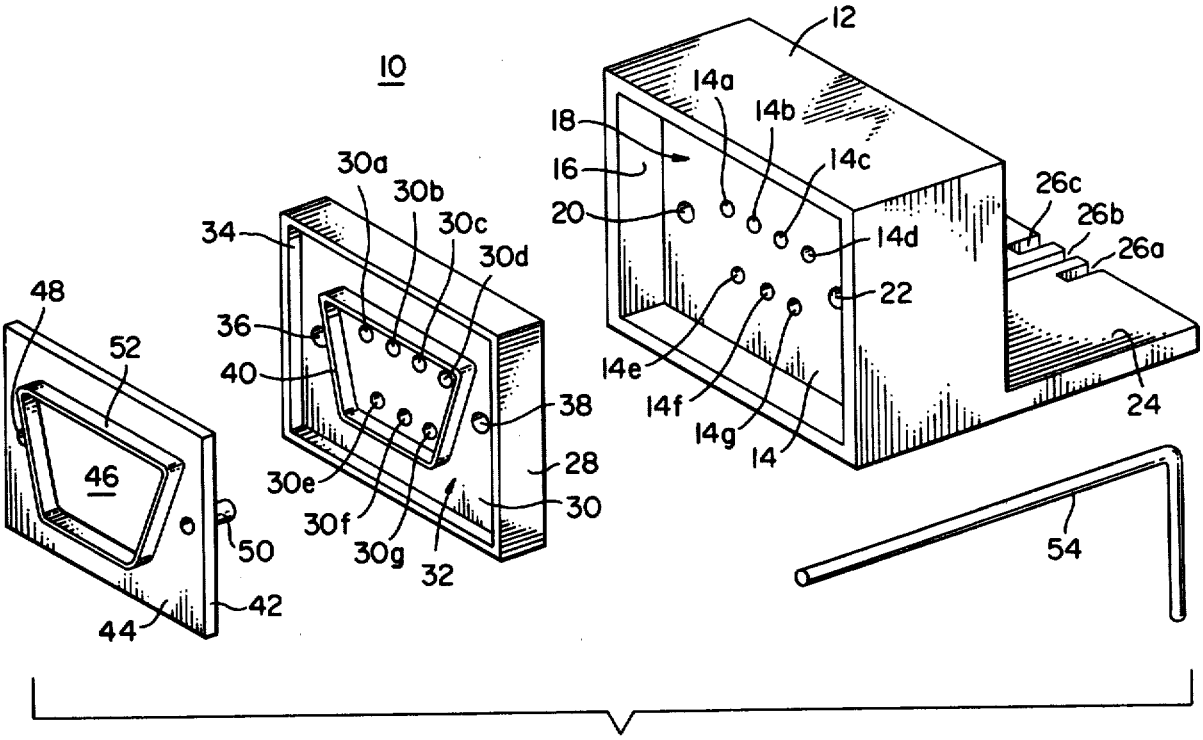
FIG. 1 is an exploded view showing the component parts of a connector in accordance with the invention individually in perspective.

Referring to the exploded view of parts in FIG. 1, connector 10 includes a housing 12 having an upstanding front wall 14. A forward or nose portion 16 of the housing extends outwardly in overhanging manner to wall 14, thereby defining a frontal recess 18 bounded perimetrically by nose portion 16. Contact-receiving-/supporting apertures **14*a*–14*g* are situated in a generally central area of wall 14 and are arranged in D-configuration, for example, four contacts in the upper of two rows and three contacts in the lower row, staggered respectively laterally of the housing such that the lateral sequence is upper contact, lower contact, upper contact, etc. At the leftward margin of wall 14, the connector includes securement/fastener passage 20. Like passage 22 is situated at the rightward margin. A housing 24 extends rearwardly of wall 14 and provides contact exit channels 26*a* through 26*g*, channels 26*a*–26*c* being visible in FIG. 1**.

Resilient/elastomeric member 28 is formed of rubber or like material displaceable under force for sealing purposes. Member 28 has a flat rear wall and an upstanding front wall 30 and has its depth and perimetric/-boundary dimensions selected such that member 28 is tightly nestable in recess 18 of housing 12. Recess 32 is provided frontally in member 28, being bounded perimetrically by resilient member nose portion 34. Contact passages **30*a*–30*g* extend centrally through wall 30, to be in registry with housing apertures 14*a*–14*g* upon nesting of member 28 in housing recess 18. Securement-/fastener passages 36 and 38 extend through member 28 to register with counterpart housing passages 20 and 22. An endless rib 40 projects outwardly of wall 30 in circumscribing relation to contact passages 30*a*–30*g***.

Insert 42 is a rigid body formed preferably of the same plastic material as housing 12 and serves as a form of closure member for the connector, as will be best seen in connection with discussion of FIGS. 2 and 3 below. The insert 42 has a flat rear wall and an upstanding front wall 44 in which is formed central opening 46 to expose resilient member contact passages 30*a*–30*g* and permit extension of contacts therethrough for access exteriorly of the insert. The insert 42 is dimensioned selectively in depth and perimetric boundary so as to be tightly nestable in resilient member recess 32 and has securement/fastener guides 48 and 50 placed so as to extend through passages 36 and 38 of the resilient member and into passages 20 and 22 of the housing upon such compound nesting of the connector parts. Nose portion 52 of insert 42 projects outwardly of wall 44 and is dimensioned so as to contiguously circumscribe endless rib 40 of resilient member 28. In the preferred form, the guides 48 and 50 and the nose portion 52 are formed integrally with the insert 42. The nesting of insert 42 in member 28 will thus be seen to be in part an interior nesting and in other part an exterior nesting.

The remaining connector component in FIG. 1 is contact 54, shown below housing 12 for convenience of illustration of contact structure. In the indicated embodiment, contact 54 may comprise an electrically conductive metal rod exhibiting a ninety-degree bend outwardly of the rear wall of the housing. The indicated connector will be recognized as of right-angle header variety, typically for connection transition between a printed circuit board (PCB) disposed in a plane parallel to housing floor 24 and an upstanding panel-mounted connector having socket contacts also parallel to housing floor 24.

Figure 2:
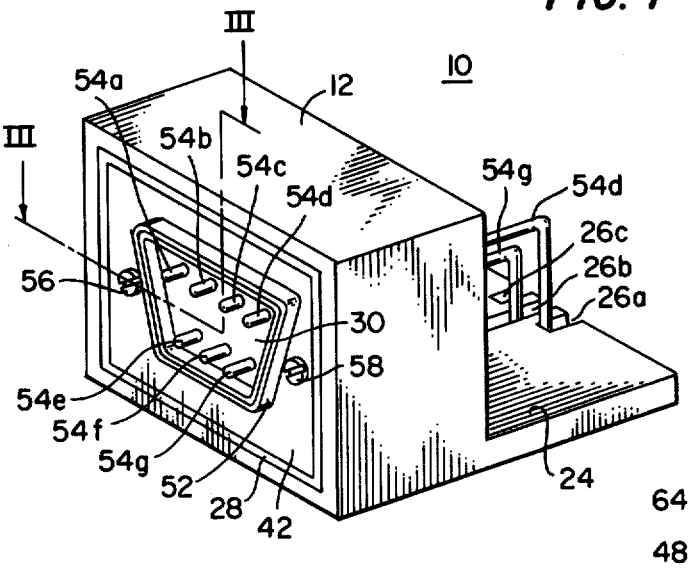
FIG. 2 is a perspective view of the FIG. 1 connector with component parts assembled.

Turning now to the assembled showing of connector 10 in FIG. 2, resilient member 28 is shown nested in housing 12 and insert 42 nested in resilient member 28, with fasteners 56 and 58 in place to secure the components together in moisture-sealed relation. Contacts 54*a* through 54*g* extend through wall 30 interiorly of the nose portions of member 28 and insert 42 and are accessible to socket contacts (not shown) of an accessory apparatus connector. Rightwardly in FIG. 2, contacts 54*d* and 54*g* are shown extending through floor 24 to be accessible for PCB connection.

Figure 3:
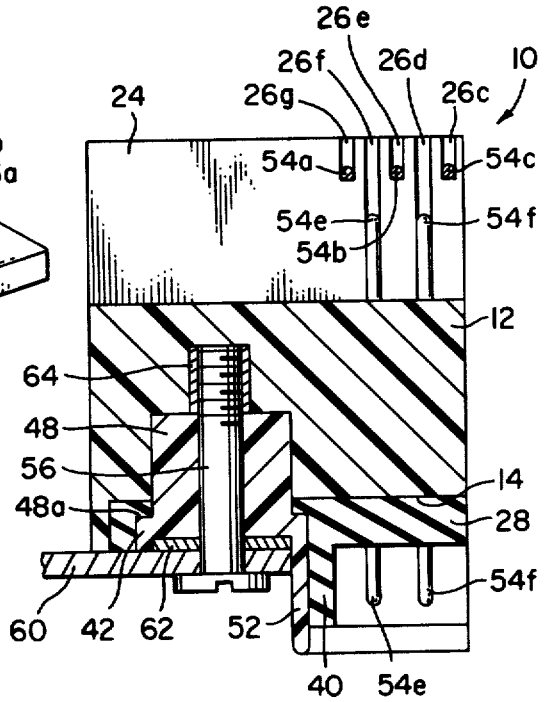
FIG. 3 is a sectional view of the FIG. 2 connector as seen from plane III—III of FIG. 2.

A more detailed understanding of the preferred sealing function of member 28 and its structural interrelationship with the other connector components is seen in FIG. 3. For this purpose, the FIG. 3 view is a sectional view, as would be seen downwardly of plane III—III of FIG. 2 with the FIG. 2 connector modified to be mounted to a panel identified by reference numeral 60 in FIG. 3. In assembly of the components of FIG. 3, contacts 54 are inserted into housing 12 to be flush with channel 26. Thus, upper leftmost contact 54*a* is inserted into the housing (through the rear of opening 14*a*—FIG. 1) until it seats against the forward wall of exit channel 26*g*. Lower leftmost contact 54*e* is inserted likewise until it seats against the forward wall of exit channel 26*f*, etc. Resilient member 28 is next seated in the housing such that its rear wall is flush with housing wall 14, the contacts being forced into and through the resilient member contact passages. Insert 42 is next assembled, its fastener guides first entering the assembly of member 28 and housing 12. Considering illustrated guide 48, it enters the housing to become flush with interiorly-threaded housing fitting 64, whereupon its notched area 48*a* becomes flush with the region of member 28 adjacent fastener passage 36 thereof (FIG. 1). With the insert, sealing member and housing thus assembled, spring washer 62 is seated against guide 48 and the assembly is disposed against the rearward side of panel 60 and the securements 56 and 58 are inserted through the panel and assembly and threaded into fittings 64. A plurality of liquid-tight seals are provided thereupon, i.e., between member 28 and the contacts extending therethrough, between member 28 and insert 42, between member 28 and panel 60 and between member 28 and housing 12. Further, as a companion connector, such as one terminating a flat cable in environmental-proof manner and discussed above in connection with the referenced commonly-assigned patent application, enters within nose portion 40 of member 28, further liquid-tight sealing is effected with housing of such companion connector circumscribing its contacts and resident in nose portion 40. Environmental-proofed connection thus extends from connections of insulation-piercing contacts to flat cable conductors, through sockets of such contacts, and through the connection interface of such sockets and pin contacts shown herein and PCB connection with the pin contacts.

Various modifications of the foregoing particularly described embodiment of the invention and changes to practices above outlined will now be evident to those skilled in the art, and may be introduced without departing from the invention. The disclosed and depicted preferred embodiment is thus intended in an illustrative and not in a limiting sense. The true spirit and scope of the invention are set forth in the following claims.

What is claimed is:

1. An electrical connector comprising a housing, contact means extending through and beyond said housing for interconnection purposes, a resilient member nestably seated in said housing and contiguously circumscribing said contact means, insert means nestably seated in said resilient member for displacing said resilient member into sealed relation with said housing and said contact means, and securement means for imparting force to said insert means to effect such resilient member displacement thereby, said housing, said resilient member and said insert means definign registered securement passages, said securement means extending through said passages into secured relation with said housing.

2. The connector claimed in claim 1 wherein said contact means includes a plurality of individual contacts, said insert means defining a common opening therethrough for passage of such contact plurality.

3. The connector claimed in claim 2 wherein said insert means includes a nose portion adjacent said common opening and in contiguous circumscribing disposition with said resilient member.

4. The connector claimed in claim 1 wherein said resilient member includes a portion nestably seated in said insert means.

5. The connector claimed in claim 4 wherein said resilient member includes a nose portion extending with said contact means in spaced relation thereto, said insert means portion extending exteriorly contiguously with said resilient means nose portion.

6. An electrical connector comprising a housing defining a recess in an upstanding wall thereof and a plurality of passages extending through said wall, a resilient member disposed in said housing recess and perimetrically contiguous with housing structure bounding said recess, said resilient member having a first side contiguous with said housing wall and a second opposite side and defining passages therebetween in registry with said housing passages, said resilient member defining a recess in said second side thereof, contact means situated in such housing and resilient member passages and extending therebeyond for interconnection purposes, and insert means disposed in said resilient member recess for providing sealed relation between said resilient member and said housing and between said resilient member and said contact means.

7. The connector claimed in claim 6 wherein said insert means includes a portion contiguously circumscribing said resilient member.

8. The connector claimed in claim 7 wherein said resilient member includes a portion extending with said contact means in spaced relation thereto, said insert means portion extending exteriorly contiguously with said resilient member portion.

9. The connector claimed in claim 6 wherein said housing, said resilient member and said insert means collectively define a securement passage, said connector further including securement means extending through said securement passage into secured relation with said housing

10. The connector claimed in claim 6 wherein said insert means defines an opening therethrough for providing access to said contact means from the exterior of said connector.

11. An electrical connector comprising a housing having an upstanding wall with a central portion apertured for passage of electrical contacts therethrough, said housing defining a recess outwardly of said wall, a resilient member having one side thereof contiguous with said housing wall and defining contact passages therethrough in registry with such housing contact apertures, said resilient member being of expanse coextensive with said housing recess and including an endless rib bounding said passages therein and extending into such insert opening, a plurality of electrical contacts resident in said apertures and passages, and an insert contiguous with the side of said resilient member opposite said one side thereof and forcibly nested in such resilient member opposite side to provide a full perimetric sealed relation between said resilient member and said housing recess and further a sealed relation between said resilient member one side and said housing wall, said insert defining an opening therethrough for passage of said contacts therethrough.

12. The connector claimed in claim 11 wherein said insert includes a portion fully circumscribing said insert rib.

13. The connector claimed in claim 12 wherein said resilient member defines a recess in said opposite side thereof, and insert being nested in said resilient member opposite side recess.

* * * * *